US011067078B2

(12) United States Patent
Yamada

(10) Patent No.: US 11,067,078 B2
(45) Date of Patent: Jul. 20, 2021

(54) SCROLL COMPRESSOR HAVING SINGLE DISCHARGE PORT OPEN AT STARTING END OF FIXED-SIDE WRAP

(71) Applicant: DAIKIN INDUSTRIES, LTD., Osaka (JP)

(72) Inventor: Masahiro Yamada, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/628,960

(22) PCT Filed: Apr. 24, 2018

(86) PCT No.: PCT/JP2018/016637
§ 371 (c)(1),
(2) Date: Jan. 6, 2020

(87) PCT Pub. No.: WO2019/008875
PCT Pub. Date: Jan. 10, 2019

(65) Prior Publication Data

US 2020/0224658 A1 Jul. 16, 2020

(30) Foreign Application Priority Data

Jul. 7, 2017 (JP) ..... JP2017-133846

(51) Int. Cl.
*F03C 2/00* (2006.01)
*F03C 4/00* (2006.01)
(Continued)

(52) U.S. Cl.
CPC ..... *F04C 18/0215* (2013.01); *F04C 18/0261* (2013.01); *F04C 18/0292* (2013.01); *F04C 29/12* (2013.01); *F04C 23/008* (2013.01)

(58) Field of Classification Search
CPC ..... F04C 18/0215; F04C 18/0253; F04C 18/0261; F04C 23/008; F04C 27/005;
(Continued)

(56) References Cited

U.S. PATENT DOCUMENTS 4,498,852 A * 2/1985 Hiraga ..... F04C 18/0246 418/55.2
5,242,283 A * 9/1993 Mori ..... F04C 18/0261 418/55.2
(Continued)

FOREIGN PATENT DOCUMENTS

EP 0 061 065 A2 9/1982
JP 59-60093 A 4/1984
JP 59-67595 U 5/1984

OTHER PUBLICATIONS

JP5967595 U—Hirano—Scroll Type Fluid Machine—May 8, 1984—English Translation (Year: 1984).*
(Continued)

*Primary Examiner* — Theresa Trieu
(74) *Attorney, Agent, or Firm* — Global IP Counselors, LLP

(57) ABSTRACT

A scroll compressor includes a fixed scroll having a spiral-shaped fixed-side wrap, and a movable scroll having a spiral-shaped movable-side wrap. The fixed-side wrap and the movable-side wrap mesh with each other to form a compression chamber. The movable scroll is rotated eccentrically with respect to the fixed scroll to discharge a refrigerant compressed in the compression chamber from a single discharge port open at a starting end of turns of the fixed-side wrap. A first port expanding portion and a second port expanding portion communicating with the single discharge port to enlarge a passage area of the discharge port
(Continued)

are arranged at an interval in a circumferential direction on a root side of the fixed-side wrap of the fixed scroll.

12 Claims, 7 Drawing Sheets

(51) Int. Cl.

| | |
|---|---|
| ***F04C 18/00*** | (2006.01) |
| ***F04C 2/00*** | (2006.01) |
| ***F04C 18/02*** | (2006.01) |
| ***F04C 29/12*** | (2006.01) |
| *F04C 23/00* | (2006.01) |

(58) Field of Classification Search
CPC .... F04C 18/0292; F04C 29/12; F01C 1/0215; F01C 1/0253; F01C 1/0261
USPC ..... 418/15, 55.1–55.6, 57, 270
See application file for complete search history.

(56) References Cited

U.S. PATENT DOCUMENTS 5,427,513 A * 6/1995 Yamada ..... F04C 18/0261 418/55.2
5,582,511 A * 12/1996 Fairbanks ..... F04C 29/12 418/15
2012/0251369 A1* 10/2012 Watanabe ..... F04C 18/0215 418/55.1

OTHER PUBLICATIONS

International Preliminary Report of corresponding PCT Application No. PCT/JP2018/016637 dated Jan. 16, 2020.
International Search Report of corresponding PCT Application No. PCT/JP2018/016637 dated Jul. 24, 2018.
European Search Report of corresponding EP Application No. 18 82 7998.8 dated Oct. 27, 2020.

* cited by examiner

SCROLL COMPRESSOR HAVING SINGLE DISCHARGE PORT OPEN AT STARTING END OF FIXED-SIDE WRAP

CROSS-REFERENCE TO RELATED APPLICATIONS

This U.S. National stage application claims priority under 35 U.S.C. § 119(a) to Japanese Patent Application No. 2017-133846, filed in Japan on Jul. 7, 2017, the entire contents of which are hereby incorporated herein by reference.

BACKGROUND

Field of the Invention

The present invention relates to a scroll compressor.

BACKGROUND INFORMATION

A scroll compressor has been known in which a rotating scroll blade meshes with a spiral-shaped fixed scroll blade and is driven to rotate so that gas is compressed by utilizing a change in capacity of a compression chamber formed between these scroll blades (see, for example, Japanese Unexamined Patent Publication No. S59-60093).

Japanese Unexamined Patent Publication No. S59-60093 discloses a structure in which a groove extending in a direction of a blade height from a discharge port is cut in a ventral surface of the fixed scroll blade to increase the diameter of the discharge port. This configuration reduces fluid loss caused when the gas that has been compressed to be high pressure gas in the compression chamber passes through the discharge port, thereby improving compression efficiency.

SUMMARY

According to the invention of Patent Document 1, a portion of the fixed scroll blade is greatly cut away from its root in order to increase the diameter of the discharge port. This is disadvantageous because the root of the fixed scroll blade decreases in rigidity.

In view of the foregoing, the present invention has been achieved to ensure rigidity of a fixed-side wrap while enlarging a passage area of a discharge port.

The present disclosure provides the following solution to a scroll compressor including: a fixed scroll (40) having a spiral-shaped fixed-side wrap (42); and a movable scroll (35) having a spiral-shaped movable-side wrap (37), the fixed-side wrap (42) and the movable-side wrap (37) meshing with each other to form a compression chamber (31) therebetween, the movable scroll (35) being rotated eccentrically with respect to the fixed scroll (40) to discharge a refrigerant compressed in the compression chamber (31) from a discharge port (32) which is open at a starting end of turns of the fixed-side wrap (42).

Specifically, according to a first aspect of the disclosure, a first port expanding portion (61) and a second port expanding portion (62) communicating with the discharge port (32) to enlarge a passage area of the discharge port (32) are arranged at an interval in a circumferential direction on a root side of the fixed-side wrap (42) of the fixed scroll (40).

In the first aspect, the first port expanding portion (61) and the second port expanding portion (62) provided on the root side of the fixed-side wrap (42) can enlarge the passage area of the discharge port (32), and can reduce compression loss caused when the refrigerant passes through the discharge port (32).

Further, the first port expanding portion (61) and the second port expanding portion (62) arranged at an interval in the circumferential direction provide a partition wall (65) between the first port expanding portion (61) and the second port expanding portion (62). This can ensure the rigidity of the root of the fixed-side wrap (42).

As compared to the case of a single large port expanding portion in a size of the first and second port expanding portions (61, 62) merged together, the passage area of the discharge port (32) becomes smaller by the area of the partition wall (65). However, the partition wall (65) can function as a reinforcing rib, and thus, the passage area of the discharge port (32) can be enlarged, while ensuring the rigidity of the root of the fixed-side wrap (42).

A second aspect of the present disclosure is an embodiment of the first aspect. In the second aspect, a partition wall (65) dividing the first port expanding portion (61) from the second port expanding portion (62) has a surface facing the discharge port (32), the surface being continuous with an inner peripheral surface of the fixed-side wrap (42).

In the second aspect, the partition wall (65) dividing the first port expanding portion (61) from the second port expanding portion (62) has a surface that faces the discharge port (32) and is continuous with the inner peripheral surface of the fixed-side wrap (42). Thus, a refrigerant flowing from the compression chamber (31) toward the discharge port (32) smoothly flows along the inner peripheral surface of the fixed-side wrap (42) and the surface of the partition wall (65) facing the discharge port (32). This can reduce the compression loss.

A third aspect is an embodiment of the first or second aspect. In the third aspect, the first port expanding portion (61) is provided further toward the starting end of turns of the fixed-side wrap (42) than the second port expanding portion (62), and has a smaller passage area than the second port expanding portion (62) when viewed from an axial direction.

In the third aspect, the first port expanding portion (61) near the starting end of turns of the fixed-side wrap (42) is formed to have a smaller passage area than the second port expanding portion (62) when viewed from the axial direction. Consequently, the area cut out near the starting end of turns of the fixed-side wrap (42) where the rigidity is the lowest is reduced. This can ensure the rigidity of the starting end of turns of the fixed-side wrap (42).

A fourth aspect is an embodiment of any one of the first to third aspects. In the fourth aspect, the first port expanding portion (61) is provided further toward the starting end of turns of the fixed-side wrap (42) than the second port expanding portion (62), and has a smaller axial height than the second port expanding portion (62).

In the fourth aspect, the first port expanding portion (61) near the starting end of turns of the fixed-side wrap (42) is formed to have a smaller axial height than the second port expanding portion (62). Consequently, the area cut out near the starting end of turns of the fixed-side wrap (42) where the rigidity is the lowest is reduced. This can ensure the rigidity of the starting end of turns of the fixed-side wrap (42).

According to the aspects of the present disclosure, the first port expanding portion (61) and the second port expanding portion (62) arranged at an interval in the circumferential direction on the root side of the fixed-side wrap (42) can enlarge the passage area of the discharge port (32). Further, since the partition wall (65) dividing the first port expanding portion (61) from the second port expanding portion (62) functions as a reinforcing rib, the rigidity of the root of the fixed-side wrap (42) can be ensured.

DETAILED DESCRIPTION OF EMBODIMENT(S)

Embodiments of the present invention will be described in detail with reference to the drawings. Note that the following description of embodiments is merely an example in nature, and is not intended to limit the scope, applications, or use of the present invention.

First Embodiment

Figure 1:
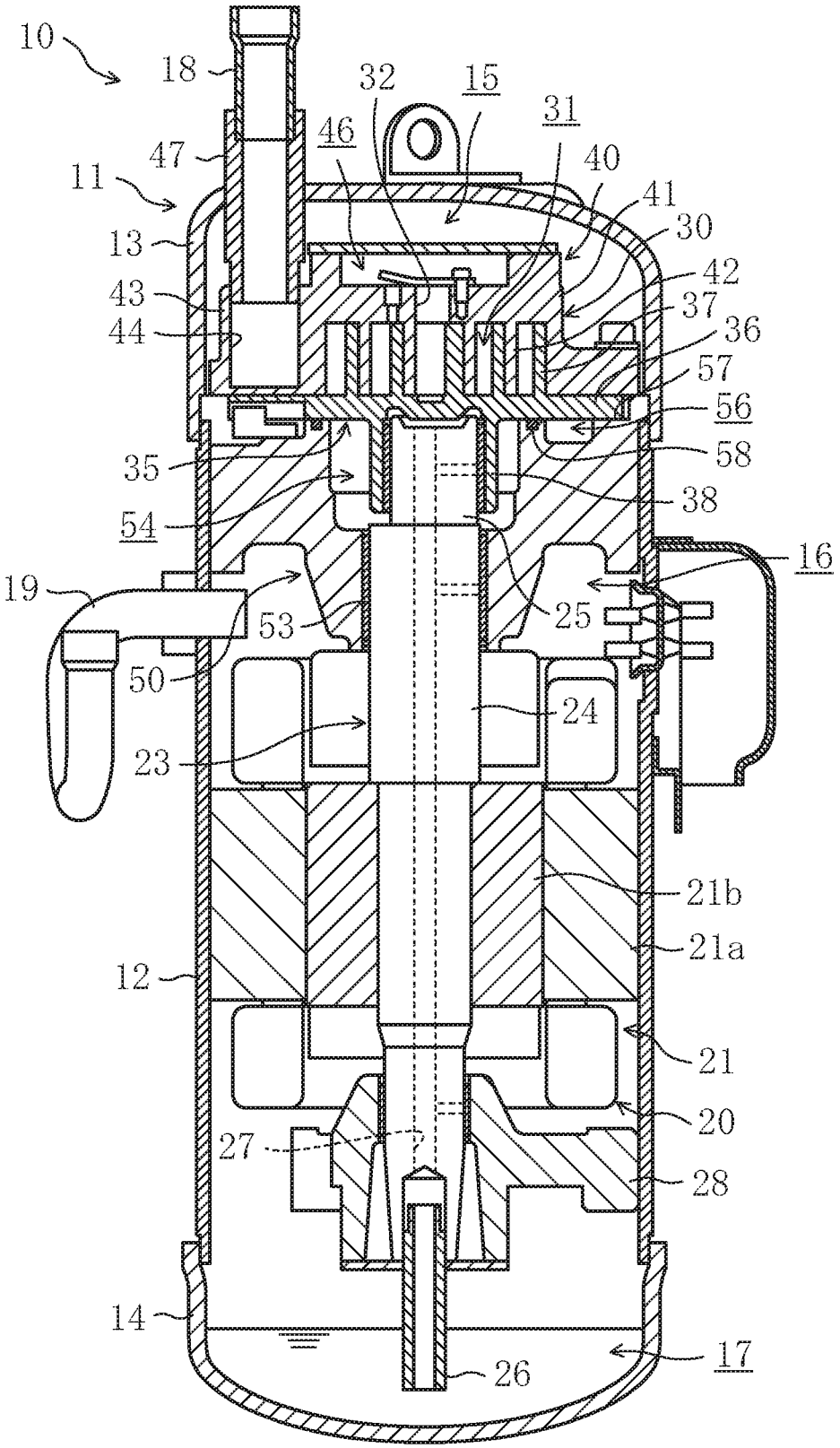
FIG. 1 is a vertical cross-sectional view illustrating the configuration of a scroll compressor according to a first embodiment.

As shown in FIG. 1, a scroll compressor (10) is connected to a refrigerant circuit performing a vapor compression refrigeration cycle of an air conditioner, for example. The scroll compressor (10) includes a casing (11), a rotary compression mechanism (30), and a drive mechanism (20) for rotationally driving the compression mechanism (30).

The casing (11) is a closed container in the shape of a vertically oriented cylinder with closed ends, and includes a cylindrical barrel (12), an upper end plate (13) fixed to an upper end of the barrel (12), and a lower end plate (14) fixed to a lower end of the barrel (12).

Space inside the casing (11) is horizontally divided by a housing (50) joined to an inner peripheral surface of the casing (11). A space above the housing (50) constitutes an upper space (15), and a space below the housing (50) constitutes a lower space (16). The configuration of the housing (50) will be described in detail later.

An oil reservoir (17) for storing lubricant that lubricates sliding portions of the scroll compressor (10) is formed at the bottom of the lower space (16) of the casing (11).

A suction pipe (18) and a discharge pipe (19) are attached to the casing (11). The suction pipe (18) penetrates the upper end plate (13) to extend upward. One end of the suction pipe (18) is connected to a suction pipe joint (47) of the rotary compression mechanism (30). The discharge pipe (19) penetrates the barrel (12). An end of the discharge pipe (19) is open in the lower space (16) of the casing (11).

The drive mechanism (20) includes a motor (21) and a drive shaft (23). The motor (21) is housed in the lower space (16) of the casing (11). The motor (21) includes a stator (21*a*) and a rotor (21*b*), both of which are formed in a cylindrical shape. The stator (21*a*) is fixed to the barrel (12) of the casing (11). The rotor (21*b*) is disposed in a hollow portion of the stator (21*a*). The drive shaft (23) is fixed to a hollow portion of the rotor (21*b*) to penetrate the rotor (21*b*) so that the rotor (21*b*) and the drive shaft (23) rotate integrally with each other.

The drive shaft (23) has a main shaft (24) extending in the vertical direction and an eccentric portion (25) provided on an upper portion of the main shaft (24), which are integrated together. The eccentric portion (25) has a smaller diameter than the maximum diameter of the main shaft (24), and is eccentric from an axial center of the main shaft (24) by a predetermined distance. A lower end portion of the main shaft (24) of the drive shaft (23) is rotatably supported by a lower bearing (28) fixed near the lower end of the barrel (12) of the casing (11). An upper end portion of the main shaft (24) is rotatably supported by a bearing (53) of the housing (50).

An oil supply pump (26) is provided at a lower end of the drive shaft (23). The oil supply pump (26) has an inlet which is open in the oil reservoir (17) of the casing (11). The oil supply pump (26) has an outlet which is connected to an oil supply passage (27) formed inside the drive shaft (23). Oil sucked from the oil reservoir (17) of the casing (11) by the oil supply pump (26) is supplied to sliding portions of the scroll compressor (10).

The compression mechanism (30) is a so-called scroll compression mechanism including a movable scroll (35), a fixed scroll (40), and a housing (50). The housing (50) and the fixed scroll (40) are fastened to each other with bolts, and the movable scroll (35) is rotatably housed between them.

The movable scroll (35) has a movable-side end plate (36) which is substantially disk-shaped. A movable-side wrap (37) stands upright on an upper surface of the movable-side end plate (36). The movable-side wrap (37) is a wall member extending radially outward in a spiral shape from the vicinity of the center of the movable-side end plate (36). A boss (38) is provided on a lower surface of the movable-side end plate (36).

Figure 2:
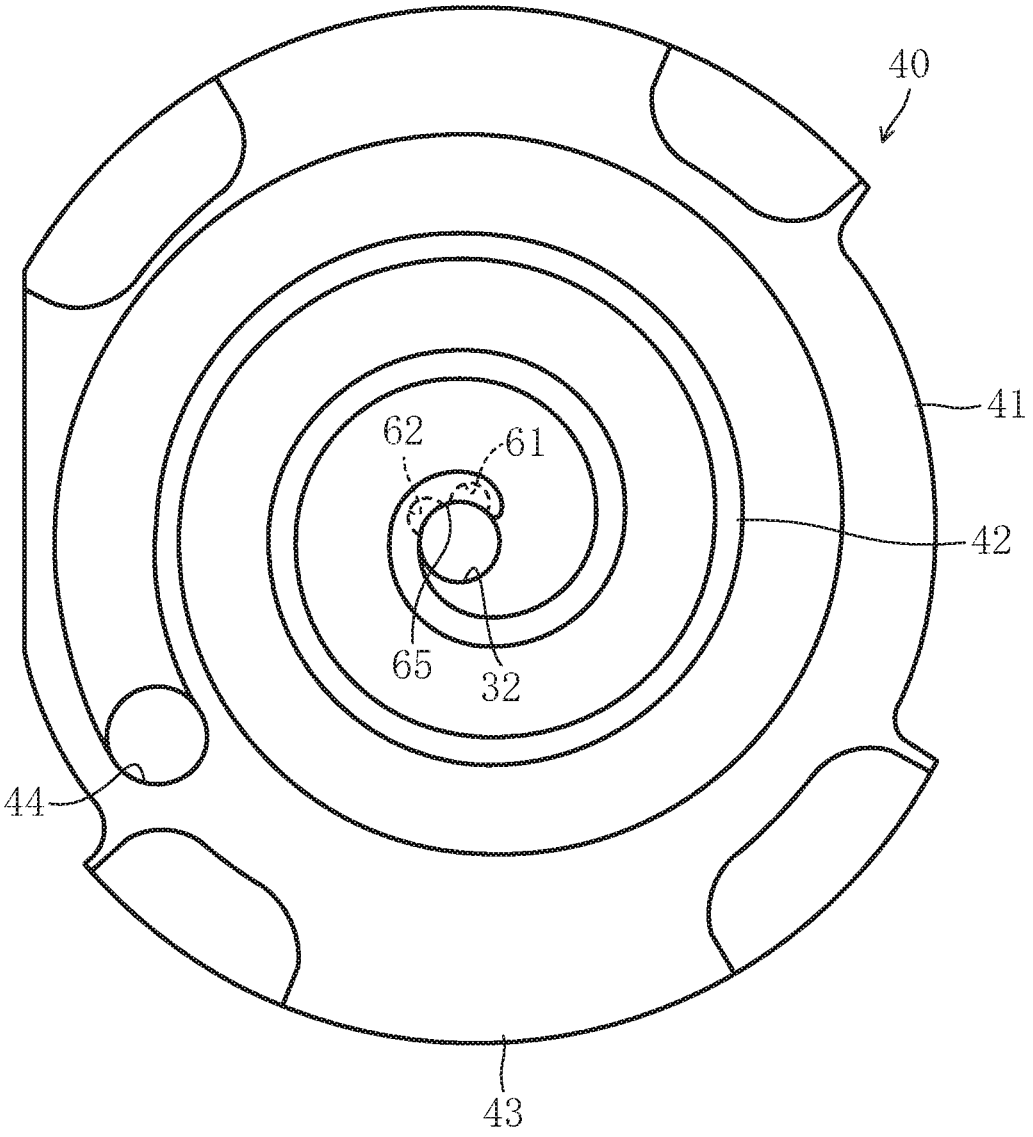
FIG. 2 is a plan view illustrating the configuration of a fixed scroll.

As shown in FIG. 2, the fixed scroll (40) has a fixed-side end plate (41) which is substantially disk-shaped. A fixed-side wrap (42) stands upright on a lower surface of the fixed-side end plate (41). The fixed-side wrap (42) is a wall member extending radially outward in a spiral shape from the vicinity of the center of the fixed-side end plate (41), and meshing with the movable-side wrap (37) of the movable scroll (35). A compression chamber (31) is formed between the fixed-side wrap (42) and the movable-side wrap (37).

The fixed scroll (40) has an outer peripheral portion (43) continuously extending outward in the radial direction from an outermost peripheral wall of the fixed-side wrap (42). A lower end face of the outer peripheral portion (43) is fixed to an upper end face of the housing (50). An opening (44) which is open upward is formed in the outer peripheral portion (43). The suction pipe joint (47) described above is connected to the opening (44) of the outer peripheral portion (43).

A discharge port (32) is formed in the vicinity of the center of the fixed-side wrap (42), i.e., near a starting end of turns of the fixed-side wrap (42), to vertically penetrate the fixed-side end plate (41) of the fixed scroll (40). A lower end of the discharge port (32) is open at a discharge position of the compression chamber (31). An upper end of the discharge port (32) is open in a discharge chamber (46) defined above the fixed scroll (40). Although not shown, the discharge chamber (46) communicates with the lower space (16) of the casing (11).

Figure 3:
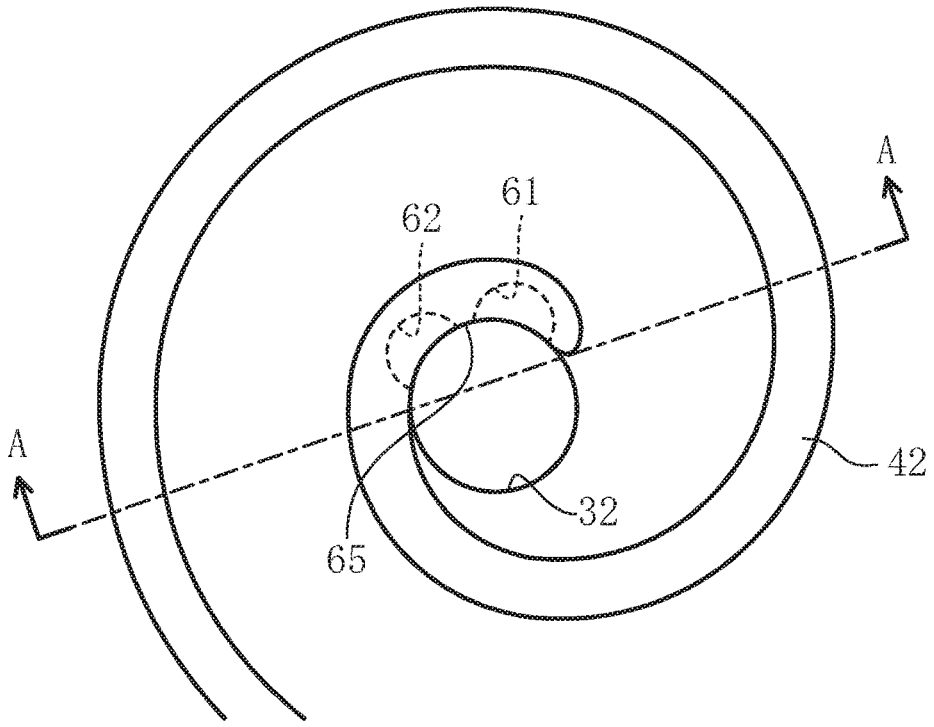
FIG. 3 is a plan view of a fixed scroll illustrating a discharge port and its periphery in an enlarged scale.
Figure 4:
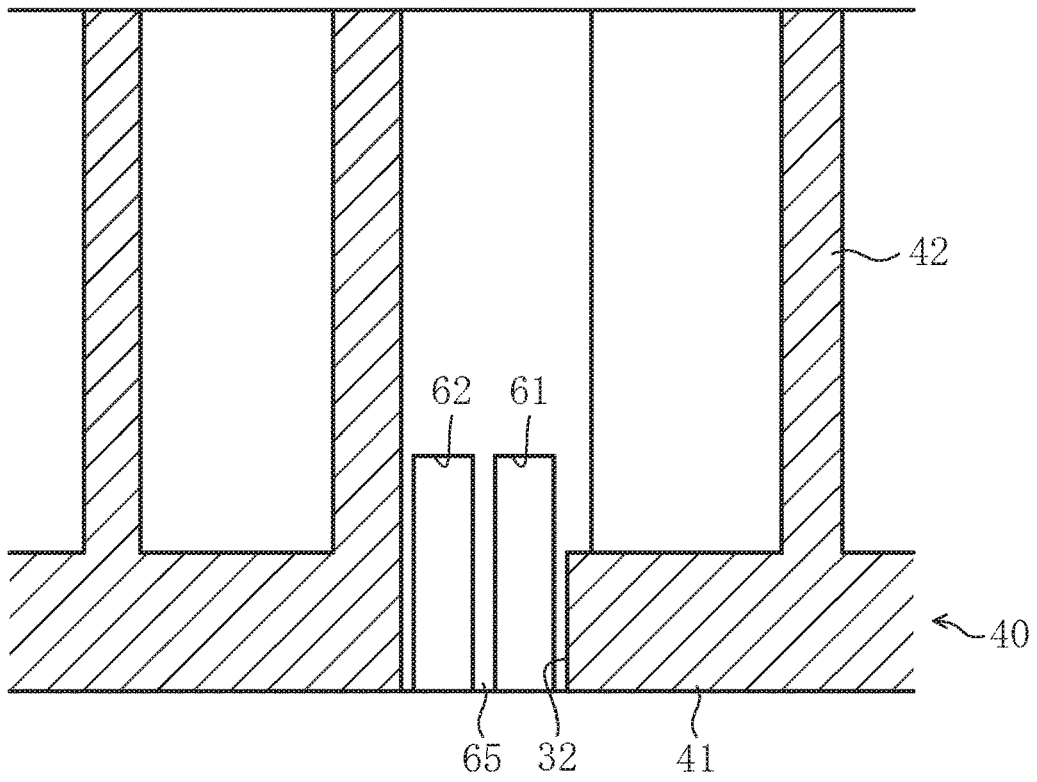
FIG. 4 is a cross-sectional view on arrow A-A of FIG. 3.

As shown in FIGS. 3 and 4, a first port expanding portion (61) and a second port expanding portion (62) communicating with the discharge port (32) to enlarge a passage area of the discharge port (32) are arranged at an interval in a circumferential direction on the root side of the fixed-side wrap (42) of the fixed scroll (40).

The first port expanding portion (61) is provided further toward the starting end of turns of the fixed-side wrap (42) than the second port expanding portion (62). The first port expanding portion (61) and the second port expanding portion (62) are holes, for example, drilled into the upper surface of the fixed scroll (40). When viewed from the axial direction, each of the holes partially overlaps with the fixed-side wrap (42), so that an inner peripheral surface of the fixed-side wrap (42) is cut out in a semicircular shape. The first port expanding portion (61) and the second port expanding portion (62) are formed to have substantially the same passage area when viewed from the axial direction.

Further, the first port expanding portion (61) and the second port expanding portion (62) penetrate the fixed-side end plate (41) to extend from the upper surface of the fixed scroll (40) toward the root side of the fixed-side wrap (42). The first port expanding portion (61) and the second port expanding portion (62) are formed to have substantially the same axial height.

The first port expanding portion (61) and the second port expanding portion (62) provided on the root side of the fixed-side wrap (42) in this manner can enlarge the passage area of the discharge port (32), and can reduce compression loss caused when the refrigerant passes through the discharge port (32).

Further, the first port expanding portion (61) and the second port expanding portion (62) arranged at an interval in the circumferential direction provide a partition wall (65) between the first port expanding portion (61) and the second port expanding portion (62). This can ensure the rigidity of the root of the fixed-side wrap (42).

The partition wall (65) dividing the first port expanding portion (61) from the second port expanding portion (62) has a surface that faces the discharge port (32) and is continuous with the inner peripheral surface of the fixed-side wrap (42). Thus, the refrigerant flowing from the compression chamber (31) toward the discharge port (32) smoothly flows along the inner peripheral surface of the fixed-side wrap (42) and the surface of the partition wall (65) facing the discharge port (32). This can reduce the compression loss.

As shown in FIG. 1, the housing (50) is formed in a substantially cylindrical shape. An outer peripheral surface of the housing (50) has an upper portion larger in diameter than a lower portion thereof. The outer peripheral surface of the upper portion is fixed to the inner peripheral surface of the casing (11).

The drive shaft (23) is inserted into a hollow of the housing (50). The hollow has an upper portion larger in diameter than a lower portion thereof. The bearing (53) is formed in the lower portion of the hollow. The bearing (53) rotatably supports the upper end portion of the main shaft (24) of the drive shaft (23). The upper portion of the hollow is divided by a seal ring (58) to form an inner back pressure space (54). The inner back pressure space (54) faces the lower surface of the movable scroll (35). The boss (38) of the movable scroll (35) is located in the inner back pressure space (54). The eccentric portion (25) of the drive shaft (23) projecting from the upper end of the bearing (53) engages with the boss (38).

An end of the oil supply passage (27) in the drive shaft (23) is open at an outer peripheral surface of the eccentric portion (25). Oil is supplied to a gap between the boss (38) and the eccentric portion (25) from the end of the oil supply passage (27). The oil supplied to the gap also flows into the inner back pressure space (54). Therefore, the pressure of the inner back pressure space (54) is the same as the pressure of the lower space (16) of the casing (11). The pressure of the inner back pressure space (54) acts on the lower surface of the movable scroll (35) to press the movable scroll (35) against the fixed scroll (40).

A recess (57) into which the movable-side end plate (36) of the movable scroll (35) fits is formed in an upper end surface of the housing (50). On a bottom surface of the recess (57), an annular outer back pressure space (56) divided by the seal ring (58) from the inner back pressure space (54) is formed. The outer back pressure space (56) faces the lower surface of the movable scroll (35).

—Operation—

It will be described below how the scroll compressor (10) stated above is operated. When the motor (21) of the scroll compressor (10) is energized, the drive shaft (23) is rotated together with the rotor (21*b*), and the movable scroll (35) is eccentrically rotated about the axis of the drive shaft (23). The capacity of the compression chamber (31) periodically increases and decreases along with the eccentric rotation of the movable scroll (35).

Specifically, when the drive shaft (23) is rotated, the refrigerant is sucked into the compression chamber (31) from the suction pipe (18). Then, the compression chamber (31) is closed along with the rotation of the drive shaft (23). As the drive shaft (23) is further rotated, the capacity of the compression chamber (31) starts to decrease, and the compression of the refrigerant in the compression chamber (31) starts.

Thereafter, when the capacity of the compression chamber (31) further decreases to a predetermined volume, the discharge port (32) is opened. The refrigerant compressed in the compression chamber (31) is discharged to the discharge chamber (46) of the fixed scroll (40) through the discharge port (32) and the first and second port expanding portions (61, 62) around the discharge port (32). The refrigerant in the discharge chamber (46) is discharged from the discharge pipe (19) via the lower space (16) of the casing (11). As described above, the lower space (16) communicates with the inner back pressure space (54), and the movable scroll (35) is pressed against the fixed scroll (40) by the pressure of the refrigerant in the inner back pressure space (54).

Second Embodiment

Figure 5:
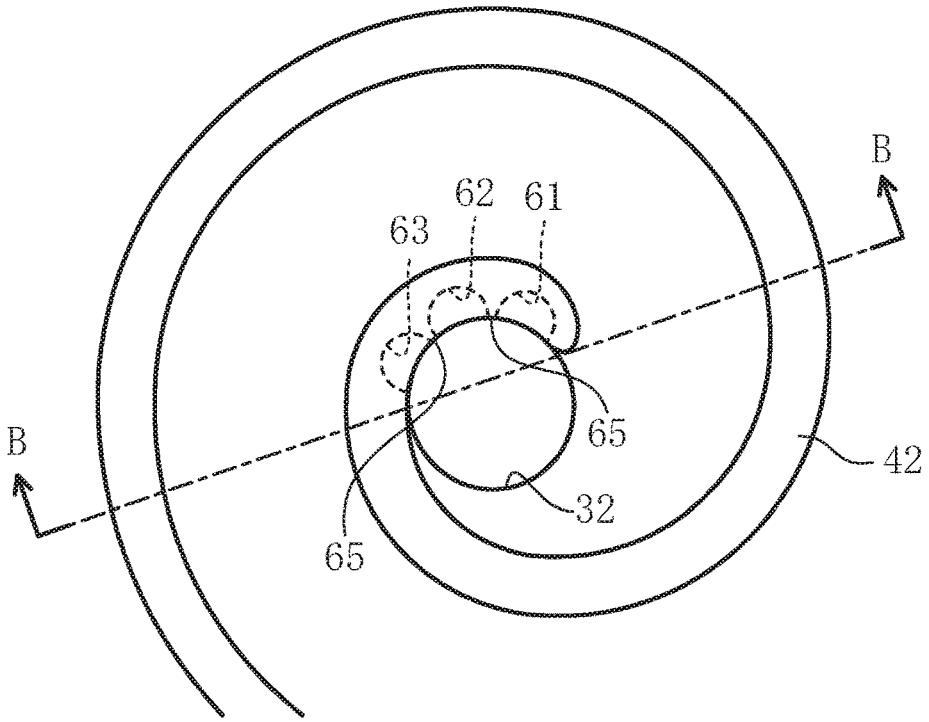
FIG. 5 is a plan view of a fixed scroll according to a second embodiment, illustrating a discharge port and its periphery in an enlarged scale.

FIG. 5 is a plan view of a fixed scroll according to a second embodiment, illustrating a discharge port and its periphery in an enlarged scale. In the following description, the same reference characters designate the same components as those of the first embodiment, and the description is focused only on the difference between this embodiment and the first embodiment.

As shown in FIG. 5, a first port expanding portion (61), a second port expanding portion (62), and a third port expanding portion (63) communicating with the discharge port (32) to enlarge the passage area of the discharge port (32) are arranged at intervals in the circumferential direction on the root side of the fixed-side wrap (42) of the fixed scroll (40).

The first, second, and third port expanding portions (61, 62, 63) are arranged in this order from a starting end of turns of the fixed-side wrap (42). The first, second, and third port expanding portions (61, 62, 63) are formed to have substantially the same passage area when viewed from the axial direction.

Figure 6:
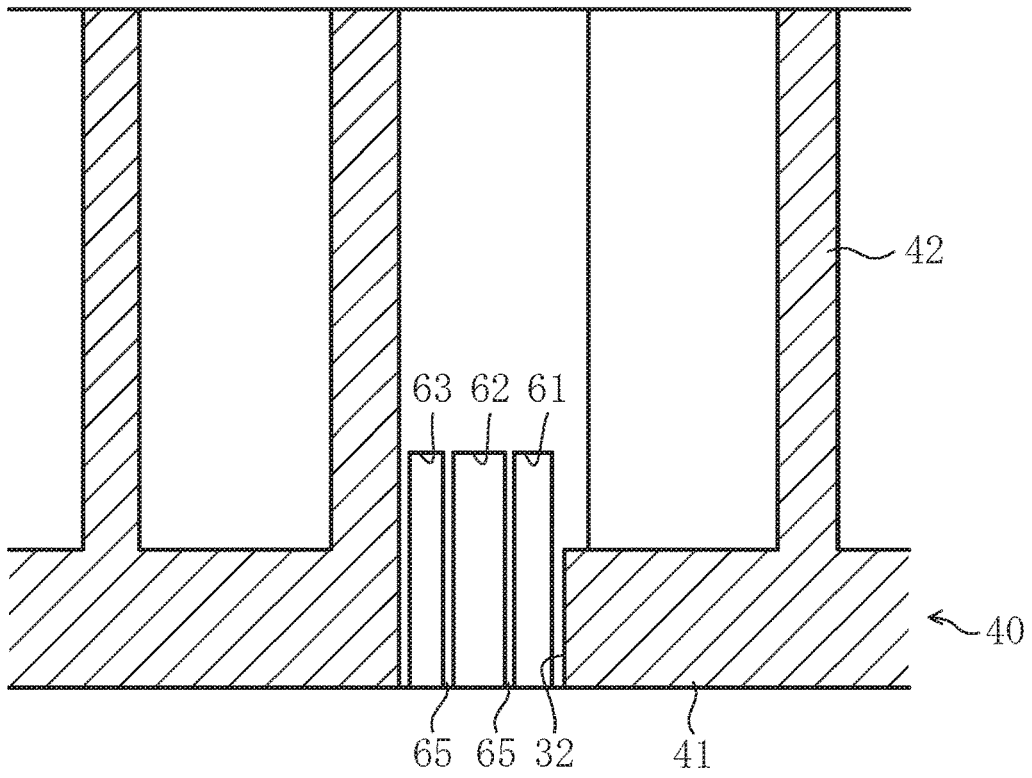
FIG. 6 is a cross-sectional view on arrow B-B of FIG. 5.

As shown in FIG. 6, the first, second, and third port expanding portions (61, 62, 63) penetrate the fixed-side end plate (41) to extend from the upper surface of the fixed scroll (40) toward the root of the fixed-side wrap (42). The first, second, and third port expanding portions (61, 62, 63) are formed to have substantially the same axial height.

The first, second, and third port expanding portions (61, 62, 63) provided in this manner on the root side of the fixed-side wrap (42) can further enlarge the passage area of the discharge port (32), while ensuring the rigidity of the root of the fixed-side wrap (42) by reducing the area cut out for each port expanding portion. This can reduce the compression loss caused when the refrigerant passes through the discharge port (32).

Further, the first, second, and third port expanding portions (61, 62, 63) arranged at intervals in the circumferential direction provide partition walls (65) between the first and second port expanding portions (61, 62), and between the second and third expanding portions (62, 63). This can ensure the rigidity of the root of the fixed-side wrap (42).

Third Embodiment

Figure 7:
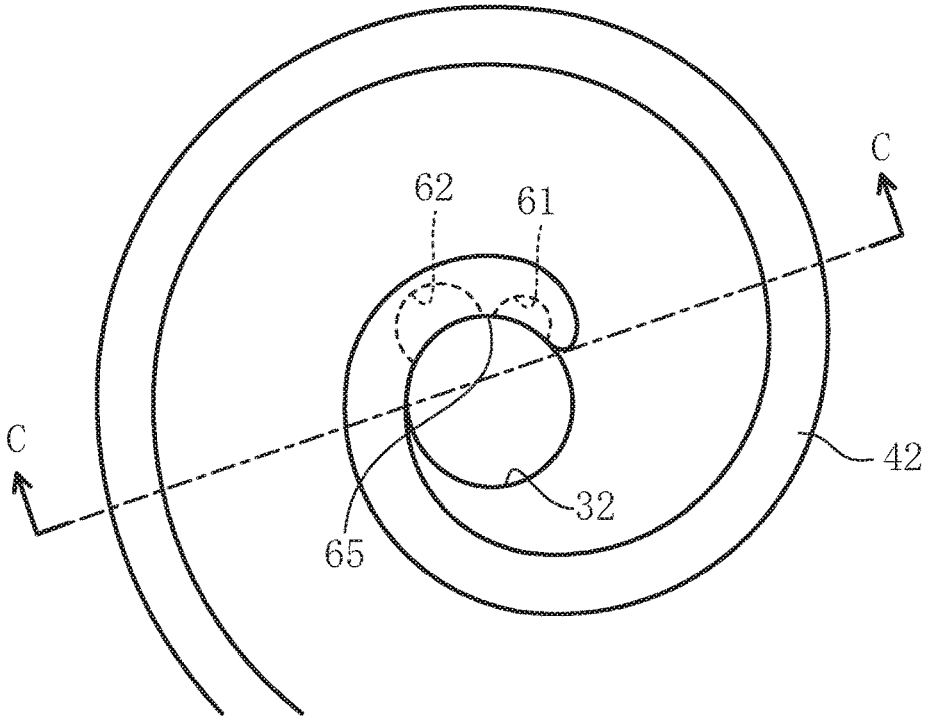
FIG. 7 is a plan view of a fixed scroll according to a third embodiment, illustrating a discharge port and its periphery in an enlarged scale.

FIG. 7 is a plan view of a fixed scroll according to a third embodiment, illustrating a discharge port and its periphery in an enlarged scale. In the following description, the same reference characters designate the same components as those of the first embodiment, and the description is focused only on the difference between this embodiment and the first embodiment.

As shown in FIG. 7, a first port expanding portion (61) and a second port expanding portion (62) communicating with the discharge port (32) to enlarge a passage area of the discharge port (32) are arranged at an interval in the circumferential direction on the root side of the fixed-side wrap (42) of the fixed scroll (40).

The first port expanding portion (61) is provided further toward the starting end of turns of the fixed-side wrap (42) than the second port expanding portion (62). The first port expanding portion (61) is formed to have a smaller passage area than the second port expanding portion (62) when viewed from the axial direction.

Figure 8:
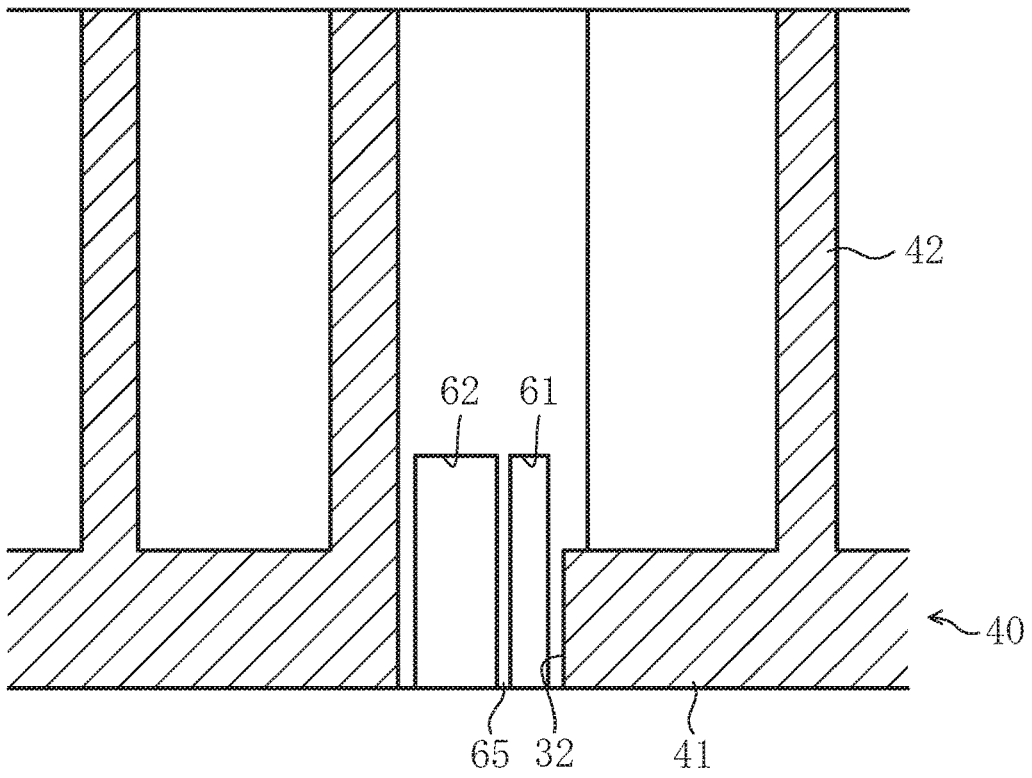
FIG. 8 is a cross-sectional view on arrow C-C of FIG. 7.

Further, as shown in FIG. 8, the first port expanding portion (61) and the second port expanding portion (62) penetrate the fixed-side end plate (41) to extend from the upper surface of the fixed scroll (40) toward the root of the fixed-side wrap (42). The first port expanding portion (61) and the second port expanding portion (62) are formed to have substantially the same axial height.

In this manner, the first port expanding portion (61) near the starting end of turns of the fixed-side wrap (42) is formed to have a smaller passage area than the second port expanding portion (62) when viewed from the axial direction, so that the area cut out near the starting end of turns of the fixed-side wrap (42) where the rigidity is the lowest is reduced. This can ensure the rigidity of the starting end of turns of the fixed-side wrap (42).

Fourth Embodiment

Figure 9:
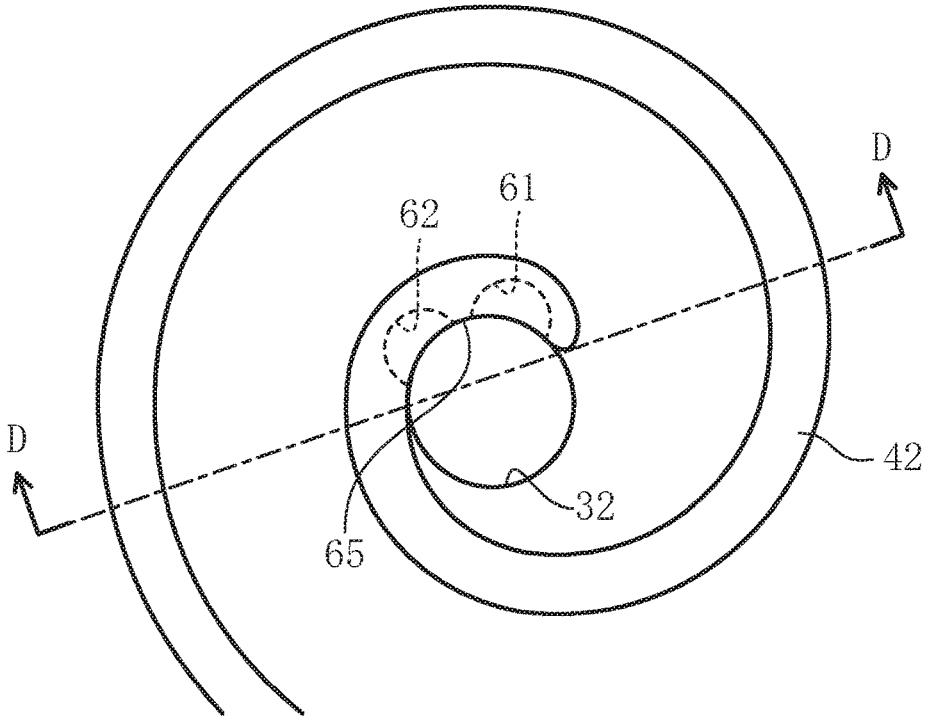
FIG. 9 is a plan view of a fixed scroll according to a fourth embodiment, illustrating a discharge port and its periphery in an enlarged scale.

FIG. 9 is a plan view of a fixed scroll according to a fourth embodiment, illustrating a discharge port and its periphery in an enlarged scale. In the following description, the same reference characters designate the same components as those of the first embodiment, and the description is focused only on the difference between this embodiment and the first embodiment.

As shown in FIG. 9, a first port expanding portion (61) and a second port expanding portion (62) communicating with the discharge port (32) to enlarge a passage area of the discharge port (32) are arranged at an interval in the circumferential direction on the root side of the fixed-side wrap (42) of the fixed scroll (40).

The first port expanding portion (61) is provided further toward the starting end of turns of the fixed-side wrap (42) than the second port expanding portion (62). The first port expanding portion (61) and the second port expanding portion (62) are formed to have substantially the same passage area when viewed from the axial direction.

Figure 10:
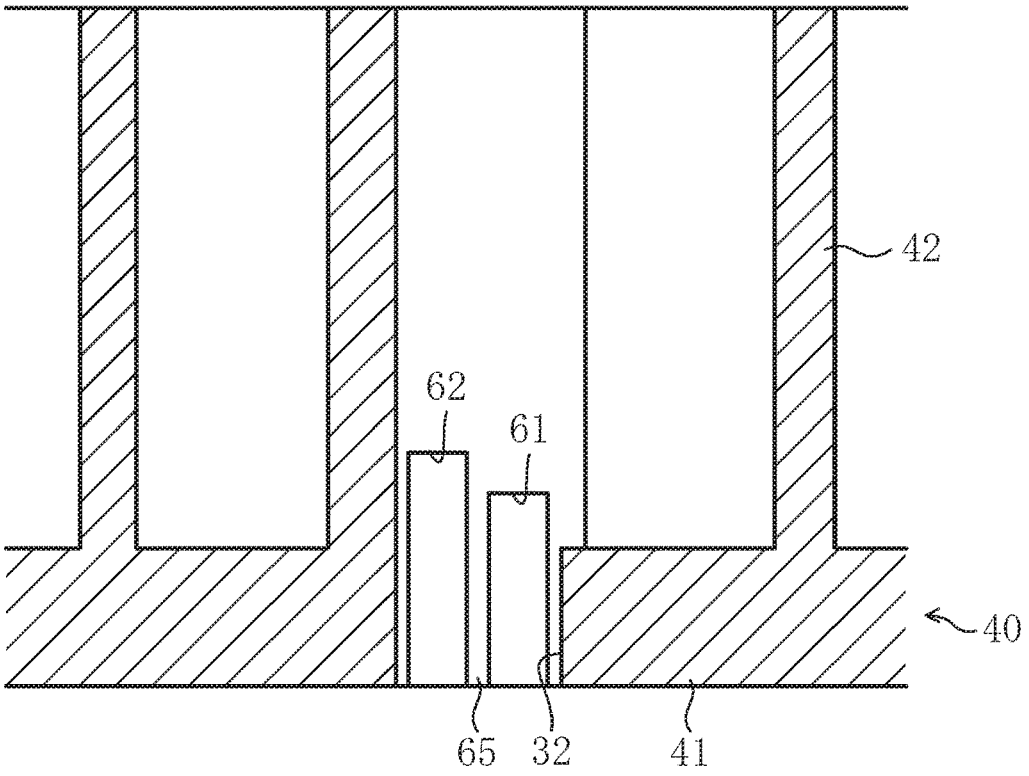
FIG. 10 is a cross-sectional view on arrow D-D of FIG. 9.

Further, as shown in FIG. 10, the first port expanding portion (61) and the second port expanding portion (62) penetrate the fixed-side end plate (41) to extend from the upper surface of the fixed scroll (40) toward the root of the fixed-side wrap (42). The first port expanding portion (61) is formed to have a smaller axial height than the second port expanding portion (62).

In this manner, the first port expanding portion (61) near the starting end of turns of the fixed-side wrap (42) is formed to have a smaller axial height than the second port expanding portion (62) when viewed from the axial direction, so that the area cut out near the starting end of turns of the fixed-side wrap (42) where the rigidity is the lowest is reduced. This can ensure the rigidity of the starting end of turns of the fixed-side wrap (42).

Fifth Embodiment

Figure 11:
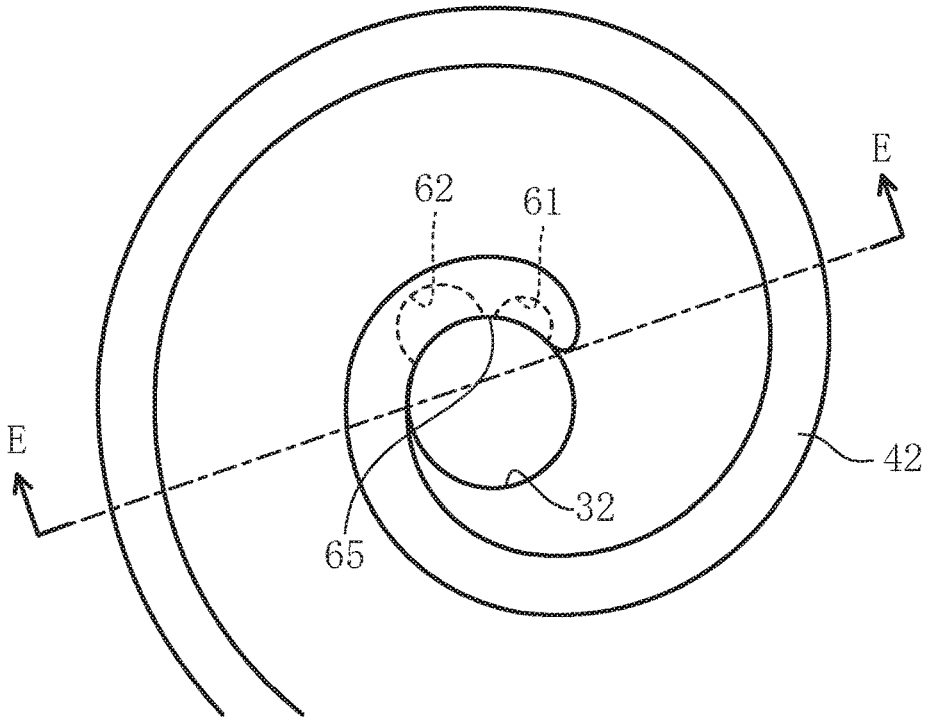
FIG. 11 is a plan view of a fixed scroll according to a fifth embodiment, illustrating a discharge port and its periphery in an enlarged scale.

FIG. 11 is a plan view of a fixed scroll according to a fifth embodiment, illustrating a discharge port and its periphery in an enlarged scale. In the following description, the same reference characters designate the same components as those of the first embodiment, and the description is focused only on the difference between this embodiment and the first embodiment.

As shown in FIG. 11, a first port expanding portion (61) and a second port expanding portion (62) communicating with the discharge port (32) to enlarge a passage area of the discharge port (32) are arranged at an interval in the circumferential direction on the root side of the fixed-side wrap (42) of the fixed scroll (40).

The first port expanding section (61) is provided further toward the starting end of turns of the fixed-side wrap (42) than the second port expanding portion (62). The first port expanding portion (61) is formed to have a smaller passage area than the second port expanding portion (62) when viewed from the axial direction.

Figure 12:
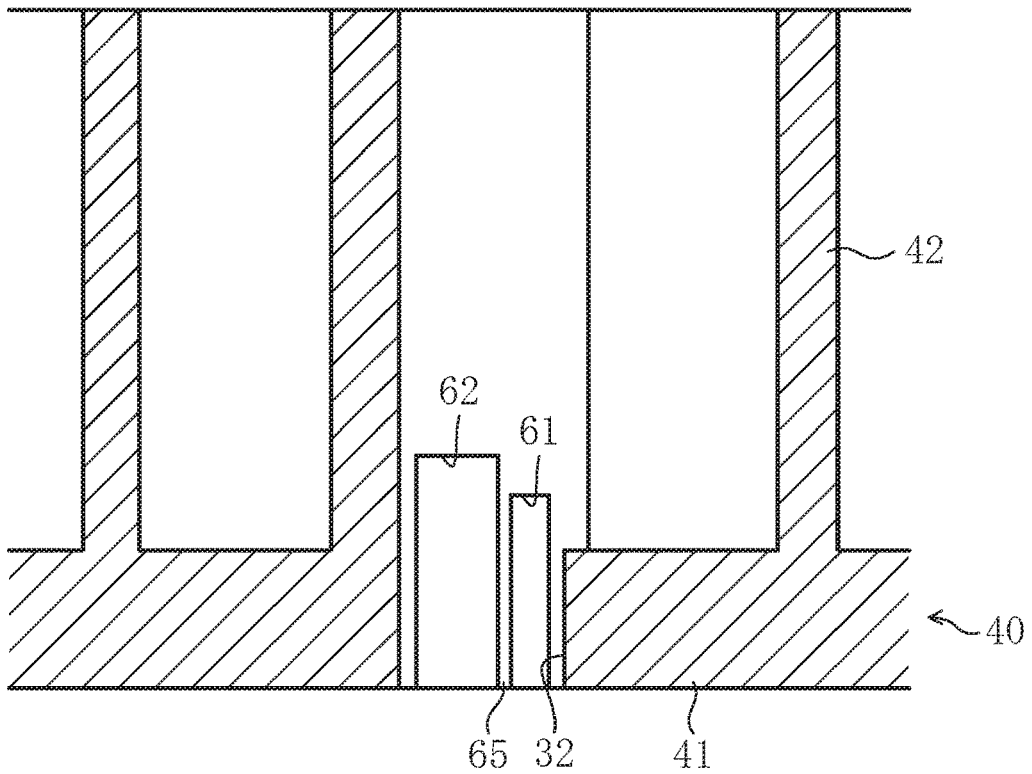
FIG. 12 is a cross-sectional view on arrow E-E of FIG. 11.

Further, as shown in FIG. 12, the first port expanding portion (61) and the second port expanding portion (62) penetrate the fixed-side end plate (41) to extend from the upper surface of the fixed scroll (40) toward the root of the fixed-side wrap (42). The first port expanding portion (61) is formed to have a smaller axial height than the second port expanding portion (62).

In this manner, the first port expanding portion (61) near the starting end of turns of the fixed-side wrap (42) is formed to have a smaller passage area than the second port expanding portion (62) when viewed from the axial direction, and a smaller axial height than the second port expanding portion (62). Consequently, the area cut out near the starting end of turns of the fixed-side wrap (42) where the rigidity is the lowest is reduced, which can ensure the rigidity of the starting end of turns of the fixed-side wrap (42).

Other Embodiments

The embodiments described above may be modified as follows.

Although it has been described in the embodiments that two or three port expanding portions are formed. However, the number of port expanding portions may be optionally determined, and can be changed as appropriate as long as the passage area of the discharge port (32) can be enlarged and the rigidity of the fixed-side wrap (42) can be ensured.

As can be seen in the foregoing, the present invention is significantly useful and industrially applicable because the invention offers practical advantages such as an enlarged passage area of a discharge port and ensured rigidity of a fixed-side wrap.

What is claimed is:

1. A scroll compressor, comprising:

a fixed scroll having a spiral-shaped fixed-side wrap; and a movable scroll having a spiral-shaped movable-side wrap, the spiral-shaped fixed-side wrap and the spiral-shaped movable-side wrap meshing with each other to form a compression chamber therebetween, the movable scroll being rotated eccentrically with respect to the fixed scroll to discharge a refrigerant compressed in the compression chamber from a single discharge port open at a starting end of turns of the spiral-shaped fixed-side wrap, a first port expanding portion and a second port expanding portion communicating with the single discharge port to enlarge a passage area of the single discharge port being arranged at an interval in a circumferential direction on a root side of the spiral-shaped fixed-side wrap of the fixed scroll, a partition wall being formed between the first port expanding portion and the second port expanding portion facing the single discharge port, and at least part of the first port expanding portion and the second port expanding portion overlapping with the spiral-shaped fixed-side wrap from the single discharge port when viewed from an axial direction.

2. The scroll compressor of claim 1, wherein the partition wall dividing the first port expanding portion from the second port expanding portion has a surface facing the single discharge port, and the surface is continuous with an inner peripheral surface of the spiral-shaped fixed-side wrap.

3. The scroll compressor of claim 2, wherein the first port expanding portion is provided further toward the starting end of turns of the spiral-shaped fixed-side wrap than the second port expanding portion, and the first port expanding portion has a smaller passage area than the second port expanding portion when viewed from an axial direction.

4. The scroll compressor of claim 2, wherein the first port expanding portion is provided further toward the starting end of turns of the spiral-shaped fixed-side wrap than the second port expanding portion, and the first port expanding portion has a smaller axial height than the second port expanding portion.

5. The scroll compressor of claim 1, wherein the first port expanding portion is provided further toward the starting end of turns of the spiral-shaped fixed-side wrap than the second port expanding portion, and the first port expanding portion has a smaller passage area than the second port expanding portion when viewed from an axial direction.

6. The scroll compressor of claim 5, wherein the first port expanding portion has a smaller axial height than the second port expanding portion.

7. The scroll compressor of claim 1, wherein the first port expanding portion is provided further toward the starting end of turns of the spiral-shaped fixed-side wrap than the second port expanding portion, and the first port expanding portion has a smaller axial height than the second port expanding portion.

8. A scroll compressor, comprising:

a fixed scroll having a spiral-shaped fixed-side wrap; and a movable scroll having a spiral-shaped movable-side wrap, the spiral-shaped fixed-side wrap and the spiral-shaped movable-side wrap meshing with each other to form a compression chamber therebetween, the movable scroll being rotated eccentrically with respect to the fixed scroll to discharge a refrigerant compressed in the compression chamber from a single discharge port open at a starting end of turns of the spiral-shaped fixed-side wrap, a first port expanding portion and a second port expanding portion communicating with the single discharge port to enlarge a passage area of the single discharge port being arranged at an interval in a circumferential direction on a root side of the spiral-shaped fixed-side wrap of the fixed scroll, and the first port expanding portion being provided further toward the starting end of turns of the spiral-shaped fixed-side wrap than the second port expanding portion, and the first port expanding portion having a smaller passage area than the second port expanding portion when viewed from an axial direction.

9. The scroll compressor of claim 8, wherein a partition wall dividing the first port expanding portion from the second port expanding portion has a surface facing the single discharge port, and the surface is continuous with an inner peripheral surface of the spiral-shaped fixed-side wrap.

10. The scroll compressor of claim 8, wherein the first port expanding portion has a smaller axial height than the second port expanding portion.

11. A scroll compressor, comprising:

a fixed scroll having a spiral-shaped fixed-side wrap; and a movable scroll having a spiral-shaped movable-side wrap, the spiral-shaped fixed-side wrap and the spiral-shaped movable-side wrap meshing with each other to form a compression chamber therebetween, the movable scroll being rotated eccentrically with respect to the fixed scroll to discharge a refrigerant compressed in the compression chamber from a single discharge port open at a starting end of turns of the spiral-shaped fixed-side wrap, a first port expanding portion and a second port expanding portion communicating with the single discharge port to enlarge a passage area of the single discharge port being arranged at an interval in a circumferential direction on a root side of the spiral-shaped fixed-side wrap of the fixed scroll, and the first port expanding portion being provided further toward the starting end of turns of the spiral-shaped fixed-side wrap than the second port expanding portion, and the first port expanding portion having a smaller axial height than the second port expanding portion.

12. The scroll compressor of claim 11, wherein a partition wall dividing the first port expanding portion from the second port expanding portion has a surface facing the single discharge port, and the surface is continuous with an inner peripheral surface of the spiral-shaped fixed-side wrap.

* * * * *